United States Patent [19]

Schleimann-Jensen et al.

[11] Patent Number: 4,879,460

[45] Date of Patent: Nov. 7, 1989

[54] GYROSLABILIZED OPTICAL RADIATION DEFLECTION DEVICE PROVIDING A STABILIZED RADIATION SENSITIVITY LOBE

[75] Inventors: Lars J. Schleimann-Jensen, Danderyd; Alf E. Engding, Akersberga; Anders F. Åström, Farsta, all of Sweden

[73] Assignee: U.S. Philips Corporation, New York, N.Y.

[21] Appl. No.: 150,369

[22] PCT Filed: May 20, 1987

[86] PCT No.: PCT/SE87/00253

§ 371 Date: Mar. 30, 1988

§ 102(e) Date: Mar. 30, 1988

[87] PCT Pub. No.: WO87/07706

PCT Pub. Date: Dec. 17, 1987

[30] Foreign Application Priority Data

Jun. 30, 1986 [SE] Sweden ..... 8602506

[51] Int. Cl.[4] ..... G01J 1/20

[52] U.S. Cl. ..... 250/230 R; 250/216

[58] Field of Search ..... 250/203 S, 203 R, 216, 250/234, 235, 236; 244/3.16; 350/6.2, 6.3, 7

[56] References Cited

U.S. PATENT DOCUMENTS 4,009,393 2/1977 Ashley, Jr. et al. ..... 250/203 R 4,030,807 6/1977 Briney ..... 250/203 R 4,039,246 8/1977 Voight ..... 350/7

4,436,260 3/1984 Donelan ..... 350/6.3

4,500,051 2/1985 Cottle, Jr. et al. ..... 244/3.16

*Primary Examiner*—David C. Nelms

*Assistant Examiner*—William L. Oen

*Attorney, Agent, or Firm*—Algy Tamoshunas; Leroy Eason

[57] ABSTRACT

A gyro stabilized optical radiation deflection device which provides a radiation sensitivity lobe which is stabilized against angular motions of the envelope in which the radiation is received or transmitted. Such device consists of a ball-shaped gyro rotor rotating about a spin axis and which is seated in a spherical recess in a support which is fixedly connected to the envelope. The central portions of the rotor and recess, through which the radiation is transmitted, are prisms which are transparent to the radiation. Such prisms together form an adjustable diffraction prism which serves as an optical wedge for directing the radiation in a directive sensitivity lobe, such direction being determined by the angle between a planar wall of the rotor prism and a planar wall of the recess prism. Such prisms are of materials having refractive indices such that an angular change of the spin axis of the gyro rotor will cause a corresponding angular change of the radiation lobe, whereby such lobe will remain parallel with the spin axis and so be independent of angular motions of the envelopes.

5 Claims, 1 Drawing Sheet

GYROSLABILIZED OPTICAL RADIATION DEFLECTION DEVICE PROVIDING A STABILIZED RADIATION SENSITIVITY LOBE

BACKGROUND OF THE INVENTION

1. Field of the Invention

The invention relates to a gyrostabilized optical deflection device for use for in the transmission path from/to a transmitter and/or receiver of radiant energy, preferably electromagnetic radiation, to provide transmission and/or reception of the said energy in a directed radiation sensitivity lobe, which device is mounted within an envelope which during operation of the device may be subjected to motions relative to fixed spatial reference directions. Such device comprises a movable deflection body having a spherical outer contour and which is seated in a spherical recess in a housing fixedly connected to the envelope, so that it is free to move in three rotational degrees of freedom in such recess, means being provided for imparting to the said body a rapid spin rotation about a spin axis which substantially coincides with the direction of the transmitted or received radiation.

2. Description of the Related Art

Such a device used in a target seeker for projectiles is described in Swedish Pat. No. SE 8502509-6. The movable deflection body therein has a reflecting plane surface or mirror adapted to reflect outgoing or incoming electromagnetic energy from/to a transmitter and/or receiver. In order to be able to direct the radiation sensitivity lobe of such reflection in any desired direction, the said body is adapted to cooperate with a two-axis magnetic torque generator which can transfer torques to the body about two mutually perpendicular axes relative to the spin axis. By its rotation about the spin axis the said deflection body at the same time serves as a gyrostabilized platform. Such a gyro stabilized platform used as deflection device for outgoing or incoming radiation can be utilized in many applications. One application is that mentioned in the said patent, namely as a gyrostabilized platform in target seekers for projectiles. Another application is anti-aircraft sights mounted on guns and also other types of sights. In common to these applications is that it is a desired that outgoing and/or incoming radiation shall remain in a fixed direction despite small angular movements of the envelope in which the device is mounted. In many applications it is furthermore a requirement that it shall be possible to adjust the radiation sensitivity lobe to any desired direction by controlled movement of the platform relative to its own space reference.

SUMMARY OF THE INVENTION

The object of the invention is to solve these problems by means of a deflection device which is mechanically more simple and less bulky than that described in the Swedish Pat. No. SE 8502509-6.

According to the invention this is achieved by means of a device of the kind as described in the opening paragraph, characterized in, that the deflection body rotating about the spin axis, is a gyro rotor which in combination with the housing seat which supports the rotor constitutes an adjustable diffraction prism for the radiation. At least a central part of the gyro rotor and the said seat, where the radiation passes, is a prism transparent to the radiation, the seat having a fixed prism wall serving as an input/output surface for the radiation and the gyro rotor having an adjustable prism wall also serving as an output/input surface. The refractive index of the materials said parts of the of which the said parts of the rotor and seat prisms are made is selected so that an angular change in direction of the spin axis of the gyro rotor results in a corresponding angular change in direction of the radiation sensitivity lobe for the outgoing and/or incoming radiation.

By its free support in the spherical recess the gyro rotor will serve as a so called two-axis gyroscope, in which besides its spin rotation the rotor is free to make angular motions about two mutually perpendicular axes relative to the spin axis perpendicular axes. In such a two-axis gyroscope the rotor tends to maintain its angular position in a fixed spatial coordinate system independently of small angular motions of the envelope supporting the rotor. If in accordance with the invention the rotor is used as a diffraction prism in a device for deflecting a radiation beam, and and since when the envelope makes small angular motions relative to the space fixed rotor the outgoing or incoming beam will make exactly the same angular motion relative to the envelope as that between envelope and rotor, it is easy to see that the radiation sensitivity lobe will be stabilized in space for small angular motions of the envelope. Consequently, if the device is included in a target seeker for projectiles the radiation sensitivity lobe of the target seeker will remain fixed in space in spite of the fact that the projectile tumbles. It is thus achieved, by the simple measure of selecting the refractive index for the diffraction prism, of which the gyro rotor is a part, that the radiation lobe will change its angle as much as the spin axis for small motions of the envelope.

It may sometimes be difficult to achieve a 1:1 ratio between an angular change of the spin axis of the gyro rotor and the resulting angular change of the radiation sensitivity lobe for outgoing or incoming radiation. The said 1:1 ratio can then be achieved by combining the deflection device with a lens system having a suitable diffraction.

Preferably the radiation or sensitivity lobe is always in parallel with the spin axis.

A deflection device in the form of an adjustable optical prism and used as scanner in a target seeker for projectiles is shown in U.S. Pat. No. 4,436,260. However, in this patent the deflection body is not imparted with spin rotation and it only serves to deflect a radiation beam. Such device cannot be used for stabilizing the direction of a radiation lobe in space.

The deflection device according to the invention, operating by transmission of radiation, has many advantages as compared with a deflection device operating by reflection. The radiation path can be made symmetrical, which may be difficult or impossible to achieve in a reflecting device. In certain applications such symmetry is essential. Secondly, since a transmissive deflection device and the transmitter/receiver can be placed in line one after the other, the mechanical construction will be very simple and of minimal volume.

The space stabilizing effect necessitates that no precession torques be transferred to the rotor. This can be achieved under continuous driving of the rotor by using a spin drive, which does not produce any such torques. In a simplier embodiment, involving smaller demands on the quality of the spin drive, this drive of the rotor can be disconnectable.

Besides the described space stabilization of the radiation or sensitivity lobe, in many applications such lobe must also be controlled to assume any desired direction relative to its own space reference. For this purpose a preferred embodiment of the device according to the invention is furthermore provided with torque generators, which are able to transfer turning torques to the deflection body about two mutually perpendicular axes relative to the spin axis.

BRIEF DESCRIPTION OF THE DRAWINGS

The invention is illustrated by means of example with reference to the accompanying drawings, in which.

DESCRIPTION OF THE PREFERRED EMBODIMENTS

Figure 1:
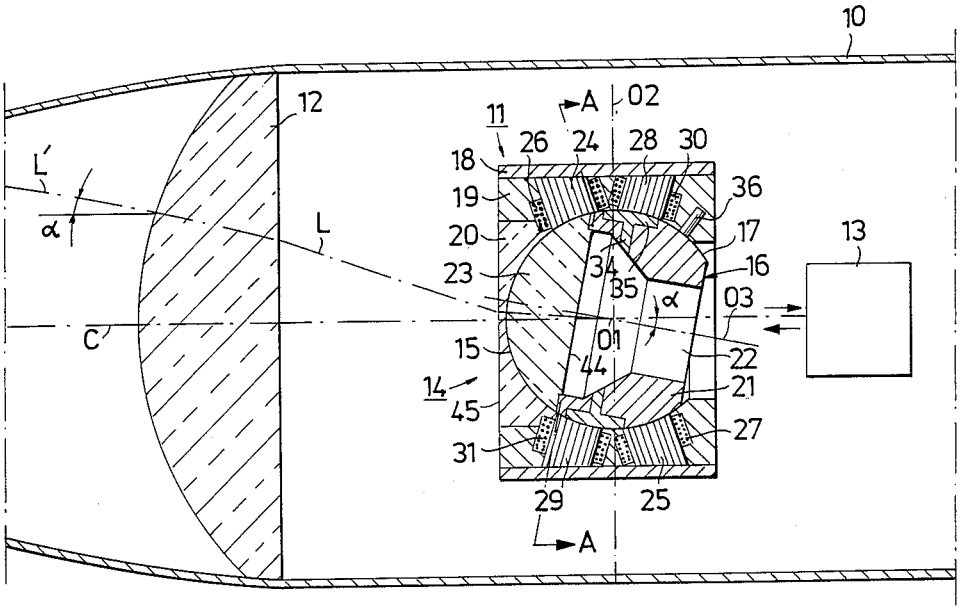
FIG. 1 shows a longitudinal sectional view of a projectile with a gyrostabilized deflection device according to the invention and FIG. 2 shows a sectional view through the deflection device, taken along the line A—A in FIG. 1.

In FIG. 1 reference numeral 10 designates a projectile envelope, while 11 is a gyrostabilized deflection device according to the invention, fixedly mounted in the envelope. A converging lens is also mounted in the envelope, and also a transmitter/receiver 13. The central axis C of the projectile forms at the same time the central axis for the deflection device and lens. The deflection device can form a gyrostabilized platform in a target seeker, which for example operates with electromagnetic energy in the millimeter wavelength range.

The deflection device consists of a support 14 fixedly mounted in the envelope 10 and having a spherical recess 15, in which a movable deflection body 16 with spherical outer contour 17, or ball, is introduced. The fixed support 14 is in the shown example composed by three parts: an outer circular cylindrical ring 18 of soft magnetic material, an intermediate prism 19 of non-magnetic material and a central part 20 of a material having a suitable refractive index for the transmitted radiation. The parts 19 and 20 are the elements which with the said recess 15 form together a housing or seat for the movable ball 16. The ball 16 is in the shown example composed by two parts: an outer ring-shaped part 21 with a central recess 22 and a hemispherical prism part 23. In operation the incoming and outgoing radiation passes through the recess 22 in the ball 16 and through the prisms 23 and 20, which in combination form a diffraction prism or "optical wedge" which forms a radiation lobe for the transmitted or received radiation, and furthermore through the lens 12. The central ray for such a radiation lobe is shown in the drawing and designated with L. As a result of its spherical shape the ball 16 is free to move by a turning or rotational motion in all three rotational degrees of freedom in its recess 15. The ball 16 is shaped so its center of gravity coincides with the rotational center for the said motions, whereby no torques will be transferred to the ball during acceleration and deceleration of the envelope 10 in which the device 11 is mounted.

Figure 2:
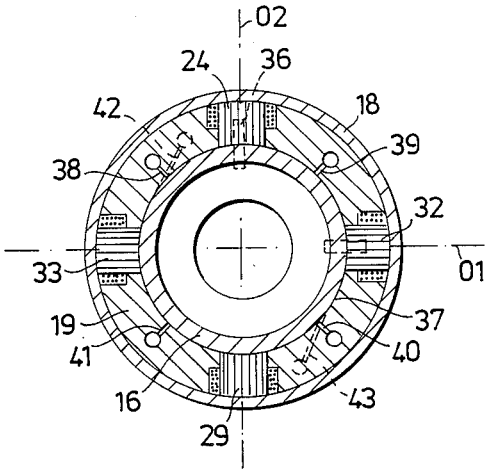

In order to be able to transfer torques to the ball 16 for turning the same about two axes 01 and 02, a magnetic torque generator is used of the kind described and shown in Swedish Pat. No. SE 8502509-6. For turning the ball 16 in one direction about the axis 01 there are two magnetic poles 24 and 25 with electrical windings 26, 27. For turning the ball in the opposite direction about the same axis 01 there are two magnetic poles 28, 29 with electrical windings 30, 31. For turning the ball 16 about the axis 02 there are similar magnetic pole pairs, as shown in FIG. 2 by the magnetic poles 32, 33 and associated windings. The fixed magnetic poles cooperate with a soft magnetic part 34 of the movable ball 16, which part 34 terminates in an equatorial ring 35 of soft magnetic material on the surface of the ball, which ball for the rest is made of non-magnetic material. The outer circular cylindrical fixed ring 18 of soft magnetic material interconnects the outwardly facing ends of all magnetic poles with each other and will close all magnetic field paths.

In order to be able to sense the instantaneous angular position of the ball the fixed part of the deflection device comprises an angle detector 36, which for example cooperates with an optical marking on the surface of the movable ball 16.

Between the spherical recess 15 in the fixed support 14 and the outer spherical surface 17 of the ball 16 there is an air-gap 37 which is active as bearing for the ball. The air-gap is maintained by continuous supply of compressed air to nozzles, which terminate in the said gap. In FIG. 2 four such nozzles with supply channels are shown and designated with 38, 39, 40, 41.

Furthermore the ball 16 is driven so as to make a rapid spin rotation about a spin axis 03. The spin rotation can be produced by means of an electrical spin motor or by air driving. In the shown example the ball 16 is rotated about the spin axis 03 by means of oblique jets of air, produced by nozzles 42, 43 with supply channels and acting on the flat outside of the ball. Hereby no precession torques will be transferred to the ball.

By its rotation about the spin axis 03 the ball 16 will form a gyro rotor, which as a result of its rotatability about the axes 01 and 02 is supported in a similar manner as in a two-axes gimbal support. The central hemispherical prism part 23 of this gyro rotor forms at the same time in combination with the central prism 20 of the fixed support 14 a variable diffraction prism for the transmitted radiation, having a plane surface 44 which serves as an input/output surface for the radiation. Surface 44 forms a variable angle with a plane surface 45 of the prism part of support 14, which said last surface also serves as output/input surface for the radiation. Within the envelope 10 the transmitter/receiver 13 for the transmitted radiation is arranged on the central axis of the deflection device. By setting the movable prism surface 44 of the rotor 16 at different angles relative to the prism surface 45 of the fixed support 14, the direction for the outgoing and/or incoming radiation, in the drawing represented by the central ray L' of the radiation lobe, can be set arbitrarily. Decisive for how the direction of the radiation or sensitivity lobe varies with a variation of the angular setting of the rotor 16 about the axes 01 and 02 is the refractive index for the materials of which the prisms 23 and 20 included in the composite diffraction prism are made, in combination with the diffraction produced by the lens 12. According to the invention the refractive index for the prisms 23 and 20, which suitably are made of the same material, is selected in such manner that the outgoing radiation or sensitivity lobe represented by L' is always parallel with the spin axis 03 of the rotor. In the drawing the lobe center line L' and the spin axis 03 both form an angle $\alpha$ with the projectile symmetry center line C. As the gyro rotor 16 in absence of precession torques transmitted to the same tends to maintain a set position in space, this will mean that the radiation lobe will be space stabilized for small angular motions of the envelope 10. From this space reference the lobe can then be controlled in any desired manner by transferring torques to the gyro rotor via the two-axis electromagnetic torque generator.

The refractive index of the material of which the prisms 23 and 20 included in the diffraction prism are made can be selected so that the diffraction prism alone gives rise to the desired 1:1 ratio between an angular change of direction of the radiation or sensitivity lobe and an angular change of direction. The spin axis of the rotor, the lens 12 will then be superfluous and can be omitted. If a lens 12 is required it may, instead of being made as a separate lens, be integrated with the deflection device by giving the prism surface 44 or the surface 45, or both, a concave or convex shape.

Examples of suitable materials for prisms 20 and 23 for different kinds of radiation are as follows:

radar radiation: plastics and ceramics,

IR-radiation: crystalline materials, as silicon, germanium, zinkselenide and others; also certain glasses and plastics, visible light: glass and plastics, ultrasonic radiation: plastics and metals.

If the device has for its only purpose to stabilize the direction of a radiation lobe in space the torque generator will be superfluous and can be omitted. The spin motor, which also can be of electrical type, may be so constructed that it drives the gyro rotor to a home position and can furthermore be disconnectable, so that the rotor after disconnection rotates freely.

We claim:

1. gyrostabilized optical radiation deflection device for mounting in an envelope which includes a transmitter and/or receiver of radiation outgoing from or incoming to such envelope, said device being in the radiation path from/to such transmitter or receiver and providing a directed sensitivity lobe for said radiation, said envelope being subject to motions relative to fixed spatial reference directions; said deflection device comprising: a rotatable deflection body having a spherical outer contour and which is seated in a spherical recess in a support which is fixedly connected to said envelope, so that said body is movable in three rotational degrees of freedom in said recess; and means for imparting rapid rotation to said body about a spin axis which substantially coincides with the direction of said radiation sensitivity lobe, so that said body serves as a gyro rotor; characterized in that:

a central portion of said rotor and a central portion of said recess are prisms transparent to said radiation, and together form an adjustable diffraction prism for deflecting said radiation sensitivity lobe;

said prism portions of said recess and said gyro motor each have a wall serving as an input/output surface for said radiation; and said prism portions of said recess and said gyro rotor are of materials having refractive indices such that an angular change in the direction of said envelope relative to the spin axis of said gyro rotor causes said diffraction prism to produce a corresponding angular change in direction of outgoing and/or incoming radiation thereto, whereby a corresponding angular change in direction of said radiation sensitivity lobe is produced relative to said envelope.

2. A gyrostabilized optical radiation deflection device as claimed in claim 1, further comprising a lens providing a further diffraction which together with the diffraction provided by said diffraction prism results in a 1:1 ratio between an angular change in direction of the spin axis of said gyro rotor and the resulting angular change in direction of said radiation sensitivity lobe.

3. A gyrostabilized optical radiation deflection device as claimed in claim 1 or 2, wherein said radiation sensitivity lobe is maintained parallel to the spin axis of said gyro rotor.

4. A gyrostabilized optical radiation deflection device as claimed in claim 1 or 2, comprising a torque generator for applying turning torques to said gyro rotor about two axes which are mutually substantially perpendicular relative to said spin axis.

5. A gyrostabilized optical radiation deflection device as claimed in claim 1, 2 or 4, wherein said gyro rotor comprises an outer ring shaped part having a central opening through which radiation may pass to said central prism portion of said gyro rotor.

* * * * *